US007517276B2

(12) United States Patent
Kuragano et al.

(10) Patent No.: US 7,517,276 B2
(45) Date of Patent: Apr. 14, 2009

(54) POWER TOOL

(75) Inventors: Shinji Kuragano, Ibaraki (JP); Tomoyoshi Yokota, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/684,185

(22) Filed: Mar. 9, 2007

(65) Prior Publication Data

US 2007/0212990 A1 Sep. 13, 2007

(30) Foreign Application Priority Data

Mar. 10, 2006 (JP) ..... P2006-065036

(51) Int. Cl.
*B24B 23/00* (2006.01)
*B24B 55/02* (2006.01)

(52) U.S. Cl. ..... 451/359; 451/451; 125/13.01

(58) Field of Classification Search ..... 451/359, 451/358, 344, 451; 125/13.01
See application file for complete search history.

(56) References Cited

U.S. PATENT DOCUMENTS 4,936,394 A 6/1990 Ohtsu
5,052,500 A * 10/1991 Ohtsu ..... 173/162.2
5,099,160 A * 3/1992 Strozel et al. ..... 310/56
7,217,178 B2 * 5/2007 Oki et al. ..... 451/359
2005/0087353 A1 4/2005 Oki et al.

FOREIGN PATENT DOCUMENTS

| | | |
|---|---|---|
| CN | 1593854 | 3/2005 |
| EP | 1514648 A2 | 3/2005 |
| EP | 1652633 A1 | 5/2006 |
| JP | 5169375 | 7/1993 |
| JP | 2534318 | 6/1996 |
| JP | 2004249430 | 9/2004 |

* cited by examiner

*Primary Examiner*—Robert Rose
(74) *Attorney, Agent, or Firm*—Mattingly, Stanger, Malur & Brundidge, P.C.

(57) ABSTRACT

A power tool has a handle holder portion having a semispherically bulging outer circumference, and an arm portion enclosing the handle holder portion and having a semispherically recessed inner circumference. The bulging outer circumference of the handle holder portion is fitted in the recessed inner circumference of the arm portion. An elastic member is clamped between a power tool body and a handle around the handle holder portion in the radial direction perpendicular to the center axis of the protruding direction of the handle holder portion. A bulging portion for limiting the sliding range of the arm portion is disposed at the leading end of the handle holder portion.

19 Claims, 2 Drawing Sheets

POWER TOOL

The present invention relates to a power tool such as a disc grinder and, more particularly, to a structure of the power tool for slidably connecting a vibrating power tool body and a handle gripped by a worker.

BACKGROUND OF THE INVENTION

In a portable power tool such as a disc grinder, in order to reduce the vibrations that occur during operation, which might otherwise be transmitted from the power tool body to the handle (or switch handle) connected to the tool body, it is the general practice to dispose a vibration-proof mechanism at the connecting portion between the tool body and the handle. In this power tool having the vibration-proof handle, it is also conventional to clamp an elastic member in the connecting portion between the power tool body and the handle, so that the vibrations from the tool body may be absorbed by the elastic member. A power tool having such a vibration-proof handle is disclosed in Patent Document 1, as follows.

[Patent Document 1] Japanese Patent No. 2,534,318

However, the power tool having the vibration-proof switch handle, as disclosed in Patent Document 1, is troubled by the complicated assembling process of interposing the elastic member between the power tool body and the handle. Another problem is that the length of the power tool body and the handle is enlarged in the direction of the center axis so that the power tool itself is large. Therefore, a power tool which can be manufactured by a relatively simple assembling process and which has a vibration-proof handle, was developed and disclosed in Japanese Patent Application No. 2004-315029.

In the proposed technique of this Patent Application, however, the structure permits the load of the handle to be concentrated at an elastic member. If the deformation of the elastic member by a load is excessively large, the elastic member is permanently deformed and deteriorated due to aging. This raises a problem that play (or looseness) occurs between the elastic member and the power tool body or the handle.

Moreover, dust such as iron powder produced at the working site, enters the arm-sliding portion between the handle holder portion formed integrally with the power tool body and the arm portion of the handle, causing wear to the handle holder portion and the handle arm portion together with the aforementioned deterioration, this wear reduces the operability of the power tool.

There is another demand for reducing the length of the power tool body and the handle in the direction of the center axis.

SUMMARY OF THE INVENTION

Therefore, one object of the invention is to provide a vibration-proof structure for preventing the deformation or reducing the deterioration of a vibration-proof elastic member, which is arranged between the power tool body and the handle.

Another object of the invention is to prevent the invasion of dust such as iron powder between the handle holder portion of the power tool body and the arm portion of the handle.

Still another object of the invention is to prevent the wear which might otherwise occur between the handle holder portion of the power tool body and the arm portion of the handle.

Still another object of the invention is to provide a power tool which has a long lifetime and excellent operability.

Representative embodiments of the invention are described in the following.

(1) According to one aspect of the invention, there is provided a power tool comprising: a housing for housing a power tool body having a tip tool at its one end; a handle holder portion protruding from the other end of the housing; a handle having an arm portion extending in the protruding direction of the handle holder portion and engaging with the handle holder portion; and a first elastic member clamped between the housing and the handle. The handle holder portion has a semispherical outer surface on the center axis in the direction protruding from the other end of the housing. The arm portion enclosing the handle holder portion has a semispherical inner surface. The outer surface of the handle holder portion is slidably fitted in the inner surface of the arm portion. A stopper for limiting the sliding range of the arm portion with respect to the handle holder portion is formed either at the leading end of the outer surface of the handle holder portion or at the leading end of the inner surface of the arm portion.

(2) According to another aspect of the invention, the stopper is constituted of a bulging portion by making the external diameter of the outer surface at the leading end of the handle holder portion in the bulging direction larger than the internal diameter of the arm portion adjoining to and inscribed in the leading end.

(3) According to still another aspect of the invention, the stopper is made of a leading end outer surface portion of the arm portion that abuts against the housing when the arm portion slides.

(4) According to still another aspect of the invention, a second elastic member is arranged in the circumferential direction of the outer surface of the handle holder portion.

(5) According to still another aspect of the invention, the second elastic member includes a pair of elastic members arranged at the housing connecting side end of the handle holder portion and at the adjoining portion of the leading end in the bulging direction.

(6) According to still another aspect of the invention, the second elastic member is arranged between the housing connecting side end of the handle holder portion and the adjoining portion of the leading end in the bulging direction.

(7) According to still another aspect of the invention, there is provided a power tool comprising: a housing for housing a power tool body having a tip tool at its one end; a handle holder portion protruding from the other end of the housing; and a handle having an arm portion extending in the protruding direction of the handle holder portion and engaging with the handle holder portion. The handle holder portion has a semispherical outer surface on the center axis in the direction protruding from the other end of the housing. The arm portion enclosing the handle holder portion has a semispherical inner surface. The outer surface of the handle holder portion is slidably fitted in the inner surface of the arm portion. A release preventing portion, for preventing the release of the arm portion protruding in the radial direction perpendicular to the center axis of the protruding direction of the handle holder portion, is formed either at the leading end of the outer surface of the handle holder portion or at the leading end of the inner surface of the arm portion.

(8) According to still another aspect of the invention, the housing includes another release preventing bulging portion that engages with a corresponding bulging portion of the switch handle.

(9) According to still another aspect of the invention, there is provided a power tool comprising: a housing for housing a power tool body having a tip tool at its one end; a handle holder portion protruding from the other end of the housing; and a handle having an arm portion extending in the protruding direction of the handle holder portion and engaging with the handle holder portion. The handle holder portion has a semispherical outer surface on the center axis in the direction protruding from the other end of the housing. The arm portion enclosing the handle holder portion has a semispherical inner surface. The outer surface of the handle holder portion is slidably fitted in the inner surface of the arm portion. An elastic member is arranged along the circumferential direction of the outer surface of the handle holder portion.

(10) According to still another aspect of the invention, the elastic member includes a pair of elastic members arranged at the housing connecting side end of the handle holder portion and at the adjoining portion of the leading end in the bulging direction.

According to the aspect of the invention of the aforementioned item (1), the stopper for limiting the sliding range of the arm portion with respect to the handle holder portion is formed either at the leading end of the outer surface of the handle holder portion or at the leading end of the inner surface of the arm portion. An excessive compression load or tension load is not applied to the first elastic member clamped between the housing and the handle. It is, therefore, possible to reduce the deterioration or permanent deformation of the first elastic member.

According to the aspect of the invention of the aforementioned item (4), the second elastic member is arranged in the circumferential direction of the outer surface of the handle holder portion. It is, therefore, possible to reduce the compression load or the tension load to be applied to the first elastic member. Especially according to the invention of the aforementioned item (5) the paired second elastic members are used so that the compression load or the tension load to be applied to the first elastic member can be reduced.

According to the aspect of the invention of the aforementioned item (7), the release preventing portion for preventing the release of the arm portion protruding in the radial direction perpendicular to the center axis of the protruding direction of the handle holder portion is formed either at the leading end of the outer surface of the handle holder portion or at the leading end of the inner surface of the arm portion. The handle holder portion can be prevented from coming out of the arm portion, even if the inner surface of the arm portion or the outer surface of the handle holder portion is worn or deformed. According to the aspect of the invention of the aforementioned item (8), the additional release preventing bulging portion is disposed so as to engage with a corresponding bulging portion of the switch handle. It is, therefore, possible to achieve the more complete release prevention of the handle holder portion and the arm portion.

According to the aspect of the invention of the aforementioned item (9), the elastic member is arranged along the circumferential direction of the outer surface of the handle holder portion. It is, therefore, possible to prevent the invasion of dust such as iron powder between the handle holder portion and the arm portion. As a result, the outer surface of the handle holder portion and the inner surface of the arm portion can be prevented from being worn or deteriorated by the dust. According to the aspect of the invention of the aforementioned item (10), the paired elastic members arranged at the housing connecting side end of the handle holder portion and at the adjoining portion of the leading end in the bulging direction makes a structure to seal the two end portions of the outer surface of the handle holder portion and the inner surface of the arm portion. It is, therefore, possible to prevent the invasion of dust more completely.

With the aforementioned advantages of the invention, it is possible to provide a power tool having a long lifetime and an excellent operability.

The aforementioned and other objects and the aforementioned and other characteristics and advantages of the invention will become more apparent from the following description of the specification and the accompanying drawings.

BRIEF DESCRIPTION OF THE DRAWINGS

An embodiment of the invention is described in detail in the following with reference to the accompanying drawings. In all the drawings for describing the various embodiments, repeated descriptions of members having common functions are omitted; such members are designated by common reference numerals.

DETAILED DESCRIPTION OF THE PREFERRED EMBODIMENTS

Figure 1:
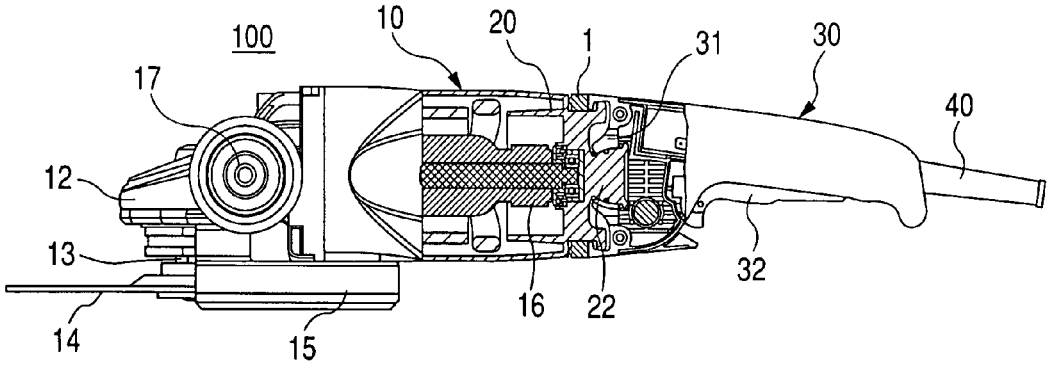
FIG. 1 is an entire constitution view (or a side elevation) showing a power tool, in which a vibration-proof handle according to one embodiment of the invention is applied to a disc grinder.

The entire constitution of a disc grinder according to the invention is described with reference to FIG. 1. A disc grinder 100 is constituted to include a disc grinder body (or a power tool body) 10, a switch handle 30 and a power cord 40 for feeding power from a commercial AC power source.

The power tool body 10 is provided with a motor housing 20 made of a metallic material, for example; a gear cover 12 made of a metallic material, for example; a tip tool 14 attached to a spindle 13 and made of a disc-shaped grinder; and a protective cover 15 for protecting a portion of the disc-shaped grinder 14. The motor housing 20 has a universal motor 16 housed therein and started by AC power fed from the power cord 40.

Figure 2:
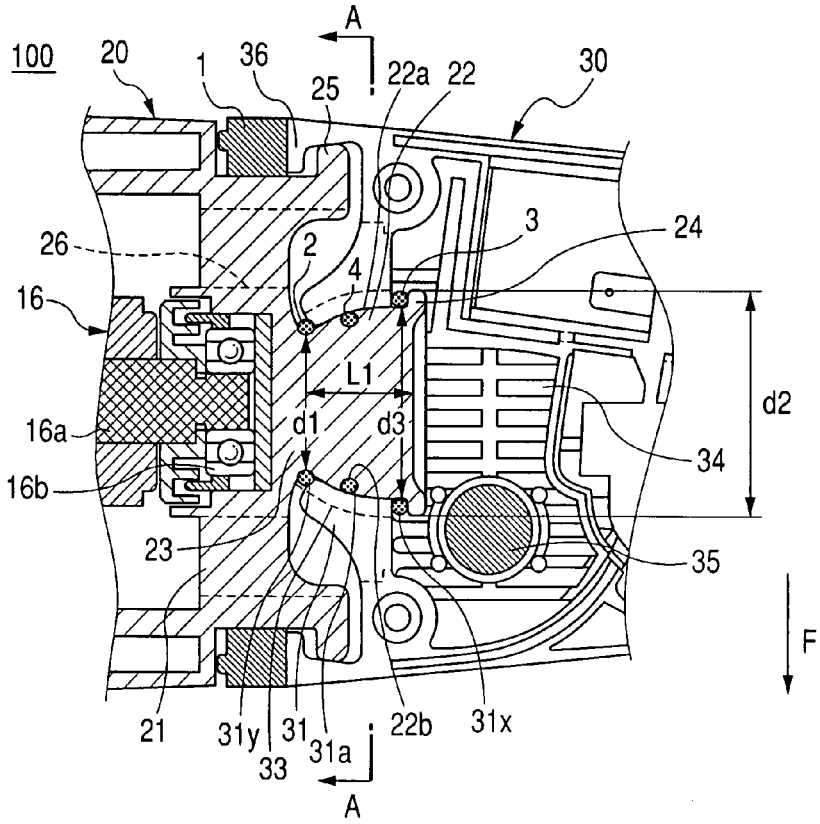
FIG. 2 is an enlarged view (or a side elevation) enlarging a portion of FIG. 1.

As shown in FIG. 2, the universal motor 16 has a spindle (or shaft) **16*a* mounted through a bearing 16*b* by a side wall 21 at one end portion of the motor housing 20. This side wall 21 has a bulge that extends from the center axis and perpendicularly thereto. The bulge has a circular sectional contour. Moreover, the gear cover 12 is provided therein with a pair of spur gears, not shown, for transmitting the rotating force of the spindle 16*a* of the universal motor 16, while changing direction, to the spindle 13. The switch handle 30 is a case made of a plastic material, for example, in which are mounted a power switch 32 that is electrically connected with the power cord 40**, and (not-shown) noise preventing electric parts.

On the circumferential edge of the side wall 21 of the motor housing 20, as shown in FIG. 2, there is fitted an elastic member 1, which is clamped between the side wall 21 and the end portion 36 of the switch handle 30. The end portion of the motor housing 20 and the opposed end portion of the handle 30, clamping the elastic member 1 therebetween, are formed in a circular shape in the sectional contour normal to the center axis. Therefore, the elastic member 1 clamped between those two members also has a section of a circular ring shape. The elastic member 1 having the ring shape may be fitted on the circumferential edge of the side wall 21 of the motor housing 20 and clamped by the switch handle 30 to facilitate the assembly.

A side handle 17 extends from the gear cover 12 in the direction normal to the drawing sheet. The drive power of the motor 16 is turned ON by the power switch 32 disposed at the switch handle 30 shown in FIG. 1. The switch handle 30 and the side handle 17 are gripped, and the grinder 14 is applied to the not-shown grinding object (or workpiece) thereby to perform work to, for example, grind an iron material or cut a stone material.

The tool body 10, the elastic member 1 and the switch handle 30 constitute together a vibration-proof handle. The features of the vibration-proof handle structure according to the invention are described in the following.

Figure 3:
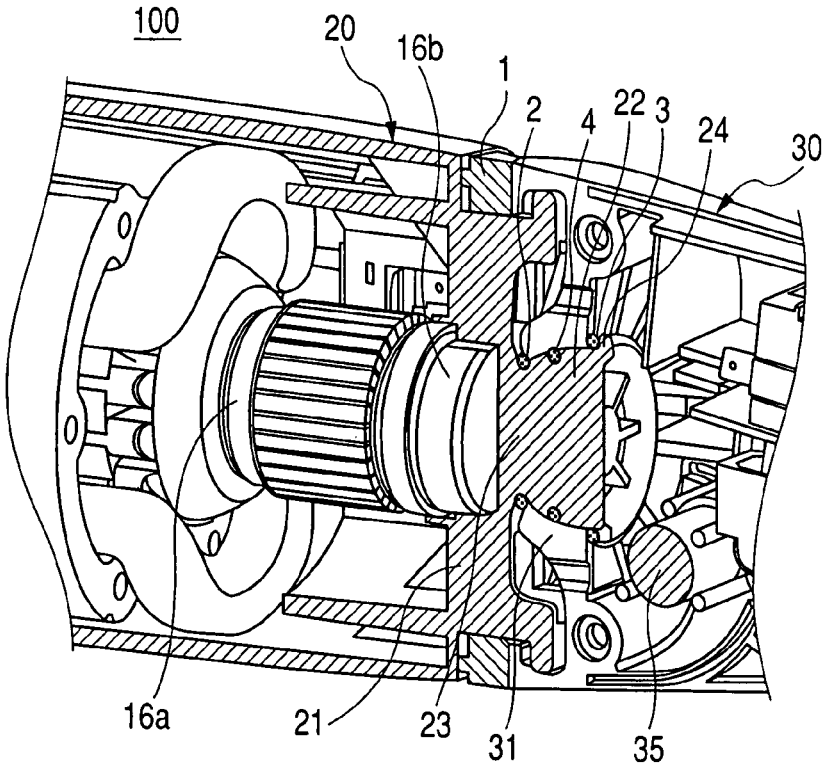
FIG. 3 is a perspective view enlarging a portion of FIG. 1.

The connecting portion between the power tool body 10 and the switch handle 30 is shown in an enlarged scale in FIG. 2 and FIG. 3. As shown in FIG. 2 and FIG. 3, a semispherical handle holder portion 22 is protruded along the center axis from the central portion in the circular section of the side wall 21 of the motor housing 20. The handle holder portion 22 has a bulging outer surface 22*a* of a semispherical shape. In short, the outer surface 22*a* has a semispherical outer surface on the radially outer side of the center axis of the handle holder portion 22 in the protruding direction.

As shown in FIG. 2, the handle holder portion 22 has a semispherical sectional shape along the center axis so that its length L1 in the center axis direction can be set short. This makes it possible to shorten the entire length of the power tool body 10, or to retain the space for housing constituent parts such as a protective resistor 35 or the like of the motor 16.

An end portion 23 on the housing connection side of the handle holder portion 22 (or the root portion of the handle holder portion 22) has a diameter d1 selected so that the load applied to the handle holder portion 22 by applying force via the switch handle 30 does not break the handle holder portion 22 at the end portion 23.

On the other hand, the switch handle 30 is provided at its end portion with an arm portion 31 to be fitted on the handle holder portion 22. The arm portion 31 has a spherically recessed inner surface (or an inner surface) 31*a* and envelops or covers the handle holder portion 22 such that it fits or engages with the outer surface 22*a* of the handle holder portion 22 through a minute gap. In short, the handle holder portion 22 is fitted in the arm portion 31 such that it can slide on the recessed inner surface 31*a* of the arm portion 31 of the switch handle 30.

With the aforementioned connection constitution of the handle holder portion 22 and the arm portion 31 of the switch handle 30, the switch handle 30 vibrates on the sphere center of the semispherically bulging outer surface 22*a* of the handle holder portion 22, when the power tool body 10 vibrates. At this time, the semispherically bulging outer surface 22*a* of the handle holder portion 22 slides in the recessed inner surface 31*a* of the arm portion 31 thereby to compress the ring-shaped elastic member 1 clamped between the tool body 10 and the switch handle 30, so that the vibrations can be absorbed.

In order that the external diameter d2 of the leading end of the semispherical outer surface 22*a* of the handle holder portion 22 may be larger than the internal diameter d3 of the arm portion 31, there is arranged a bulging portion 24, which bulges perpendicularly from the center axis. This bulging portion 24 functions as a stopper for restricting the sliding range of the arm portion 31 with respect to the handle holder portion 22. When a downward load F is applied to the arm portion 31 with respect to the handle holder portion 22, as shown in FIG. 2, the arm portion 31 slides such that its right end 31*x* abuts at its upper portion against the bulging portion 24, and such that its left end 31*y* abuts at its lower portion against the side wall 21 of the handle holder portion 22. In short, the bulging portion 24 acts, like the side wall 21 of the handle holder portion 22, as a stopper for restricting the sliding range of the arm portion 31. This bulging portion 24, acting as the stopper, reduces the load to be applied to the outer surface 22*a* of the handle holder portion 22 and the arm inner surface 31*a*, and the concentrated load to be applied to the elastic member 1. As a result, it is possible to prevent the permanent deformation or deterioration, as might otherwise be caused by the concentrated load, of the elastic member 1.

Ring-shaped elastic members (or O-rings) 2 and 3 are arranged on the bulging portion 24 and on the side wall 21 of the handle holder portion 22, respectively. The elastic member 2 contacts with the axially left end 31*y* of the arm portion 31, and the elastic member 3 contacts with the axially right end of the arm portion 31, so that both the elastic members 2 and 3 are arranged to be compressed. As a result, a load is dispersed, when applied to the switch handle 30, between the elastic members 2 and 3 so that the loads to be applied to the outer surface 22*a* of the handle holder portion 22 and the arm inner surface 31*a* are further reduced to reduce the concentrated load to be applied to the elastic member 1. Thus, it is possible to prevent the deterioration, as might otherwise be caused by the concentrated load, of the elastic member 1 more completely.

Moreover, the elastic members 2 and 3 are enabled, when loaded, to restrict or shorten the sliding distance on the handle holder portion 22 of the arm portion 31 by the aforementioned coaction between the side wall 21 and the bulging portion 24. Thus, it is possible to improve operability.

Another function of the arrangement of the bulging portion 24 is to prevent the arm portion 31 from being released (or from coming out). More specifically, the function is to prevent the arm portion 31 from coming out of the handle holder portion 22 even after the inner surface 31*a* of the arm portion 31 or the outer surface 22*a* of the handle holder portion 22 wear out. The release preventing function on the arm portion 31 can be attained even if the internal diameter of the left end 31*y* of the arm portion 31 is set small. However, the external diameter d1 of the root portion 23 of the handle holder portion 22 is set relatively large for retaining mechanical strength. Therefore, it is advantageous for the design that the release preventing function is given by the bulging portion 24.

According to the invention, moreover, a third release preventing portion is provided for the switch handle 30. At the outer edge portion of the side wall 21 of the motor housing 20, as shown in FIG. 2 and FIG. 3, a release preventing portion 25 juts perpendicularly from the center axis and engages with the circumferential edge retaining portion 36, jutting perpendicularly toward the center axis, of the switch handle 30. As a result, it is possible to prevent the release of the switch handle 30 and the tool body 10 more completely.

Figure 4:
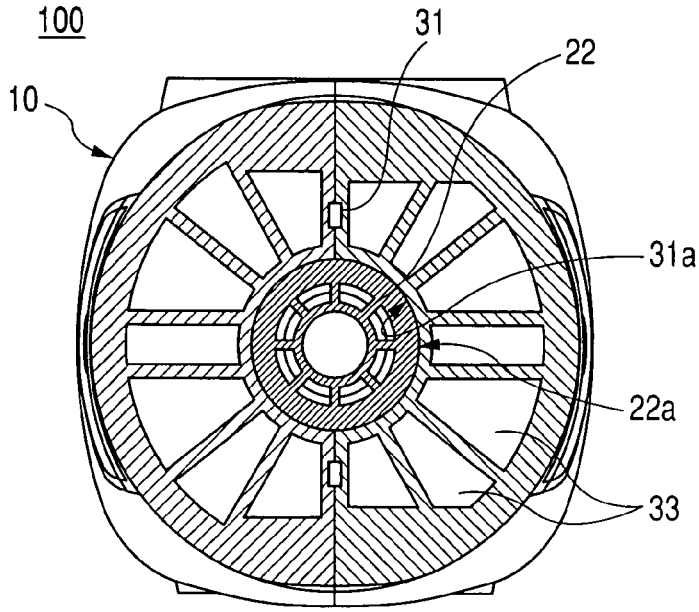
FIG. 4 is a sectional view (or a side elevation) taken along line A-A of the sectional view shown in FIG. 2.

In the side wall 21 of the motor housing 20, there is formed a vent hole 26 (indicated in FIG. 2) for introducing ambient air to cool the motor 16. This vent hole 26 forms an ambient air flow passage to communicate with vent holes 33 (indicated in FIG. 2 and FIG. 4) formed in the arm portion 31. An intake cooling fan is fixed, although not shown, on the rotary output shaft of the motor 16 positioned on the side of the gear cover 12, so that the air is introduced from an intake port 34 (shown in FIG. 2) through the vent holes 33 and the vent hole 26 into the inside of the motor housing 20 and is discharged from the (not-shown) exhaust port of the gear cover 12. This arrangement permits powder dust, such as iron dust of the working site, to be sucked from the intake port 34 into the power tool body 10.

Against this problem, according to the invention, the paired elastic members 2 and 3 are so arranged as to seal up the two end portions of the sliding faces (22*a* and 31*a*) of the handle holder portion 22 and the arm portion 31, so that the dust (or the powder dust) such as the iron powder can be prevented from invading into the sliding faces. In the case of a stone cutting work, for example, cutting chips of stone fall as the work proceeds. These cutting chips are sucked from the intake port 34 formed in the switch handle 30 so that they invade between the sliding faces (31*a* and 22*a*) causing wear and deterioration of the outer surface 22*a* of the handle holder portion 22 and the arm portion inner surface 31*a*. By arranging the elastic member 2 or the elastic member 3, however, the powder dust is less likely to invade into the sliding portion, thereby preventing the wear and deterioration. This function of preventing the invasion of the dust is effective so long as at least one of the paired elastic members 2 and 3 is provided.

According to the invention, moreover, another elastic member 4 of an O-ring is inserted into the central portion of the handle holder portion outer surface 22*a* in the direction of the center axis. This elastic member 4 is so inserted into a groove 22*b* formed in the outer surface 22*a* of the handle holder portion 22 that a proper urging force is applied to the inner surface 31*a* of the arm portion 31 thereby to prevent play (or looseness) between the handle holder portion 22 and the arm portion 31 and to improve operability.

According to the disclosed embodiments of the invention, as is apparent from the description thus far made, there is provided a power tool comprising a vibration-proof handle for sliding a handle holder portion having a semispherically bulging outer surface and a handle having an arm portion having a semispherically recessed inner surface. Wear of the vibration-proof handle can be reduced by reducing the deterioration or permanent deformation of the elastic member used in the vibration-proof handle, and by preventing the invasion of dust into the sliding portion (or the fitting portion) between the handle holder portion and the arm portion. As a result, it is possible to provide a power tool which is excellent in operation and which has a vibration-proof handle having an extremely low rate of aging.

Although our invention has been specifically described with respect to its preferred embodiments, it is not limited to the foregoing embodiments but could be modified in various manners within a scope not departing from the gist thereof.

We claim:

1. A power tool comprising:

a housing for housing a power tool body having a tool at a first end thereof;

a handle holder portion protruding from a second end of said housing different from said first end;

a handle having an arm portion extending parallel to an axis defined in a direction in which said handle holder portion protrudes, wherein said handle engages with said handle holder portion;

a first elastic member clamped between said housing and said handle;

wherein said handle holder portion has a semispherical outer surface;

wherein said arm portion has a semispherical inner surface;

wherein said handle holder portion is positioned at least partly within said arm portion;

wherein said outer surface of said handle holder portion is slidably fitted in said inner surface of said arm portion; and a stopper for limiting the sliding range of said arm portion in the direction of said axis with respect to said handle holder portion, wherein said stopper is formed at one of the leading end of said outer surface of said handle holder portion or the leading end of said inner surface of said arm portion.

2. A power tool as set forth in claim 1, wherein said stopper comprises a bulging portion of the handle holder portion at the leading end of said handle holder portion, wherein said bulging portion of the handle holder portion has an external diameter that is larger than the internal diameter of said arm portion adjoining to and inscribed in said leading end of said outer surface of said handle holder portion.

3. A power tool comprising:

a housing for housing a power tool body having a tool at a first end thereof;

a handle holder portion protruding from a second end of said housing different from said first end;

a handle having an arm portion extending parallel to an axis defined in a direction in which said handle holder portion protrudes, wherein said handle engages with said handle holder portion;

a first elastic member clamped between said housing and said handle;

wherein said handle holder portion has a semispherical outer surface;

wherein said arm portion has a semispherical inner surface;

wherein said handle holder portion is positioned at least partly within said arm portion;

wherein said outer surface of said handle holder portion is slidably fitted in said inner surface of said arm portion; and a stopper for limiting the sliding range of said arm portion in the direction of said axis with respect to said handle holder portion, wherein said stopper is formed at one of the leading end of said outer surface of said handle holder portion or the leading end of said inner surface of said arm portion, wherein said stopper comprises a leading end outer surface portion of said arm portion that abuts against said housing when said arm portion slides;

a second elastic member arranged on said handle holder portion in the circumferential direction of said outer surface of said handle holder portion.

4. A power tool as set forth in claim 3, wherein said second elastic member includes a first elastic element arranged on said handle holder portion at a first side thereof toward said second end of said housing in the direction of said axis, and a second elastic element arranged on said handle holder portion at a second side thereof opposite said first side in the direction of said axis toward said leading end of said outer surface of said handle holder portion.

5. A power tool as set forth in claim 3, wherein said second elastic member is arranged on said handle holder portion at a first side thereof toward said second end of said housing in the direction of said axis, between said housing and said leading end of said outer surface of said handle holder portion.

6. A power tool comprising:

a housing for housing a power tool body having a tool at a first end thereof;

a handle holder portion protruding from a second end of said housing different from said first end;

a handle having an arm portion extending parallel to an axis defined in a direction in which said handle holder portion protrudes, wherein said handle engages with said handle holder portion;

wherein said handle holder portion has a semispherical outer surface;

wherein said arm portion has a semispherical inner surface;

wherein said handle holder portion is positioned at least partly with said arm portion;

wherein said outer surface of said handle holder portion is slidably fitted in said inner surface of said arm portion; and a release preventing portion for preventing release of the arm portion in a radial direction perpendicular to said axis and limiting the sliding range of said arm portion in the direction of said axis with respect to said handle holder portion, wherein said release preventing portion is formed at one of the leading end of said outer surface of said handle holder portion or the leading end of said inner surface of said arm portion.

7. A power tool comprising:

a housing for housing a power tool body having a tool at a first end thereof;

a handle holder portion protruding from a second end of said housing different from said first end;

a handle having an arm portion extending parallel to an axis defined in a direction in which said handle holder portion protrudes, wherein said handle engages with said handle holder portion;

wherein said handle holder portion has a semispherical outer surface;

wherein said arm portion has a semispherical inner surface;

wherein said handle holder portion is positioned at least partly with said arm portion;

wherein said outer surface of said handle holder portion is slidably fitted in said inner surface of said arm portion; and a release preventing portion for preventing release of the arm portion in a radial direction perpendicular to said axis, wherein said release preventing portion is formed at one of the leading end of said outer surface of said handle holder portion or the leading end of said inner surface of said arm portion, wherein said housing includes a second release preventing portion at the outer surface of said handle holder portion, wherein said second release preventing portion engages with a corresponding bulging portion of said handle.

8. A power tool comprising:

a housing for housing a power tool body having a tool at a first end thereof;

a handle holder portion protruding from a second end of said housing different from said first end;

a handle having an arm portion extending parallel to an axis defined in a direction in which said handle holder portion protrudes, wherein said handle engages with said handle holder portion;

wherein said handle holder portion has a semispherical outer surface wherein said arm portion has a semispherical inner surface;

wherein said handle holder portion is positioned at least partly within said arm portion;

wherein said outer surface of said handle holder portion is slidably fitted in said inner surface of said arm portion; and an elastic member arranged on said handle holder portion in the circumferential direction of said outer surface of said handle holder portion.

9. A power tool as set forth in claim 8, wherein said elastic member includes a first elastic element arranged on said handle holder portion at a first side thereof toward said second end of said housing in the direction of said axis, and a second elastic element arranged on said handle holder portion at a second side thereof opposite said first side in the direction of said axis toward said leading end of said outer surface of said handle holder portion.

10. A power tool as set forth in claim 1, further comprising a motor housed in said housing, and a switch housed in said handle and arranged to switchably deliver power to said motor for driving said tool.

11. A power tool as set forth in claim 8, further comprising a motor housed in said housing, and a switch housed in said handle and arranged to switchably deliver power to said motor for driving said tool.

12. A power tool as set forth in claim 1, wherein said handle holder portion has a semispherical sectional shape, including an equator arranged at said leading end of said outer surface of said handle holder portion and perpendicular to said axis.

13. A power tool as set forth in claim 8, wherein said handle holder portion has a semispherical sectional shape, including an equator arranged at said leading end of said outer surface of said handle holder portion and perpendicular to said axis.

14. A power tool comprising:

a housing that holds a disc shaped grinder at a first end thereof;

a motor that is housed inside the housing;

a handle that is engaged with the housing, and having a switch to control a power supply to the motor; and a first elastic member that is positioned between the housing and the handle, wherein the housing has an outer surface, wherein the handle has an inner surface that is formed to fit to the outer surface of the housing so that the housing and the handle are slidably engaged therethrough, wherein the housing has a protruding portion, and wherein the handle has a disengage-preventing portion that is formed to fit the protruding portion so that the handle is prevented from being disengaged from the housing.

15. The power tool according to claim 14, wherein the first elastic member is positioned closer to the disc shaped grinder as compared with the protruding portion and the disengage-preventing portion.

16. The power tool according to claim 14, wherein the outer surface is positioned inside with respect to the protruding portion.

17. The power tool according to claim 14, wherein each of the outer surface and the inner surface includes a substantially semispherical surface.

18. The power tool according to claim 14, wherein the handle includes:

an intake port that introduces an ambient air; and a first vent hole that guides the introduced ambient air, and wherein the housing includes a second vent hold that is communicated with the first vent hole and that guides the introduced ambient air toward an inside of the housing.

19. The power tool according to claim 14, further comprising:

a protective resistor that is disposed inside the handle.

* * * * *